US006668444B2

(12) United States Patent
Ngo et al.

(10) Patent No.: US 6,668,444 B2
(45) Date of Patent: Dec. 30, 2003

(54) METHOD FOR MANUFACTURING A WOUND, MULTI-CORED AMORPHOUS METAL TRANSFORMER CORE

(75) Inventors: Dung A. Ngo, Morris Plains, NJ (US); Kimberly M. Borgmeier, Waltham, MA (US)

(73) Assignee: Metglas, Inc., Conway, SC (US)

( * ) Notice: Subject to any disclaimer, the term of this patent is extended or adjusted under 35 U.S.C. 154(b) by 29 days.

(21) Appl. No.: 09/841,944

(22) Filed: Apr. 25, 2001

(65) Prior Publication Data

US 2003/0020579 A1 Jan. 30, 2003

(51) Int. Cl.[7] ..... H01F 7/06; H01F 3/04; H01F 27/24

(52) U.S. Cl. ..... 29/606; 29/602.1; 29/605; 29/609; 336/212

(58) Field of Search ..... 29/602.1, 605, 29/606, 609; 336/213, 216, 217, 233, 234, 209, 210, 211

(56) References Cited

U.S. PATENT DOCUMENTS

| | | | | |
|---|---|---|---|---|
| 3,153,216 A | | 10/1964 | Klitten | |
| 3,212,172 A | | 10/1965 | Davis | |
| 3,233,311 A | | 2/1966 | Giegerich et al. | |
| 3,434,087 A | | 3/1969 | Hofmann | |
| 3,548,355 A | | 12/1970 | Martincic et al. | |
| 3,611,226 A | | 10/1971 | Cotton et al. | |
| 3,626,587 A | | 12/1971 | Zickar et al. | |
| 3,708,897 A | | 1/1973 | Martincic et al. | |
| 3,750,071 A | | 7/1973 | Eley | |
| 3,774,298 A | | 11/1973 | Eley | |
| 4,504,813 A | | 3/1985 | Strang | |
| 4,506,248 A | * | 3/1985 | Lin | 336/212 |
| 4,599,594 A | | 7/1986 | Siman | |
| 4,751,488 A | | 6/1988 | Lanoue et al. | |
| 5,063,654 A | * | 11/1991 | Klappert et al. | 29/609 |
| 5,093,981 A | * | 3/1992 | Ballard et al. | 29/609 |
| 5,226,222 A | * | 7/1993 | Hanaoka et al. | 29/606 |
| 5,242,760 A | | 9/1993 | Matsuoka et al. | |
| 5,261,152 A | | 11/1993 | Simozaki et al. | 29/609 |
| 5,398,403 A | * | 3/1995 | Freeman | 29/609 |
| 5,455,392 A | | 10/1995 | Preu et al. | |
| 5,470,646 A | | 11/1995 | Okamura et al. | |
| 6,411,188 B1 | * | 6/2002 | Pruess et al. | 29/602.1 |

FOREIGN PATENT DOCUMENTS

| | | | | |
|---|---|---|---|---|
| DE | 195 05 529 | | 6/1996 | |
| EP | 0 082 954 A1 | | 7/1983 | |
| EP | 0 474 371 | | 11/1992 | |
| FR | 2 289 039 | | 5/1976 | |
| GB | 965 741 | | 8/1964 | |
| GB | 1087594 | | 10/1967 | |
| GB | 1156369 | | 6/1969 | |
| JP | 06-231986 | * | 8/1994 | H01F/41/02 |
| WO | WO 99 09567 | | 2/1999 | |

OTHER PUBLICATIONS

Copy of PCT Search Report for PCT/US99/06476 dated Jul. 9, 1999.
Copy of PTO Form 892 from U.S. Ser. No. 09/276,164.
Patent Abstract of Japan Publication No. JP 58–141515 A.
Patent Abstract of Japan Publication No. 59–121810 A2.
Report titled: "National Appliance and Equipment Energy Efficiency Program, Analysis of Potential for Minimum Energy Performance Standards for Distribution transformers", Draft Final Report dated May 3, 2000 by ark Ellis & Associates, 44, Albert Street, Wagstaffe, NSW 2257, Australia.

* cited by examiner

*Primary Examiner*—Carl J. Arbes
*Assistant Examiner*—Thiem D Phan
(74) *Attorney, Agent, or Firm*—Ernesto Buff & Associates, LLC; Ernesto D. Buff; Gordon E. Fish

(57) ABSTRACT

The present invention relates to improved transformer cores formed from wound, annealed amorphous metal alloys, particularly multi-limbed transformer cores. Processes for the manufacture of the improved transformer cores, and transformers comprising the improved transformer cores are also described.

4 Claims, 6 Drawing Sheets

METHOD FOR MANUFACTURING A WOUND, MULTI-CORED AMORPHOUS METAL TRANSFORMER CORE

FIELD OF THE INVENTION

The present invention relates to transformer cores, and more particularly to transformer cores made from strip or ribbon composed of ferromagnetic material, particularly amorphous metal alloys.

BACKGROUND OF THE INVENTION

Transformers conventionally used in distribution, industrial, power, and dry-type applications are typically of the wound or stack-core variety. Wound core transformers are generally utilized in high volume applications, such as distribution transformers, since the wound core design is conducive to automated, mass production manufacturing techniques. Equipment has been developed to wind a ferromagnetic core strip around and through the window of a pre-formed, multiple turns coil to produce a core and coil assembly. However, the most common manufacturing procedure involves winding or stacking the core independently of the pre-formed coils with which the core will ultimately be linked. The latter arrangement requires that the core be formed with one or more joints for wound core and multiple joints for stack core. Core laminations are separated at those joints to open the core, thereby permitting its insertion into the coil window(s). The core is then closed to remake the joint. This procedure is commonly referred to as "lacing" the core with a coil.

A typical process for manufacturing a wound core composed of amorphous metal consists of the following steps: ribbon winding, lamination cutting, lamination stacking or lamination winding, annealing, and core edge finishing. The amorphous metal core manufacturing process, including ribbon winding, lamination cutting, lamination stacking, and strip wrapping is described in U.S. Pat. Nos. 5,285,565; 5,327,806; 5,063,654; 5,528,817; 5,329,270; and 5,155,899.

A finished core has a rectangular shape with the joint window in one end yoke. The core legs are rigid and the joint can be opened for coil insertion. Amorphous laminations have a thinness of about 0.001 inch. This causes the core manufacturing process of wound amorphous metal cores to be relatively complex, as compared with manufacture of cores wound from transformer steel material composed of cold rolled grain oriented (SiFe). In grain-oriented silicon steel, not only are the thicknesses of the cold rolled grain-oriented layers substantially thicker (generally in excess of about 0.013 inch), but in addition, the grain-oriented silicon steel is particularly flexible. These combinations of technical features, i.e., greater thicknesses and substantially greater flexibility in silicon steels immediately differentiates the silicon steel from amorphous metal strips, particularly annealed amorphous metal strips and obviates many of the technical problems associated with the handling of amorphous metal strips. The consistency in quality of the process used to form the core from its annulus shape into rectangular shape is greatly dependent on the amorphous metal lamination stack factor, since the joint overlaps need to match properly from one end of the lamination stack factor, since the joint overlaps need to match properly from one end of the lamination to the other end in the 'stair-step' fashion. If the core forming process is not carried out properly, the core can be over-stressed in the core leg and corner sections during the strip wrapping and core forming processes which will negatively affect the core loss and exciting power properties of the finished core.

Core-coil configurations conventionally used in single phase amorphous metal transformers are: core type, comprising one core, two core limbs, and two coils; shell type, comprising two cores, three core limbs, and one coil. Three phase amorphous metal transformer, generally use core-coil configurations of the following types: four cores, five core limbs, and three coils; three cores, three core limbs, and three coils. In each of these configurations, the cores have to be assembled together to align the limbs and ensure that the coils can be inserted with proper clearances. Depending on the size of the transformer, a matrix of multiple cores of the same sizes can be assembled together for larger kVA sizes. The alignment process of the cores' limbs for coil insertion can be relatively complex. Furthermore, in aligning the multiple core limbs, the procedure utilized exerts additional stress on the cores as each core limb is flexed and bent into position. This additional stress tends to increase the core loss resulting in the completed transformer.

The core lamination is brittle from the annealing process and requires extra care, time, and special equipment to open and close the core joints in the transformer assembly process. This is an intrinsic property of the annealed amorphous metal and cannot be avoided. Lamination breakage and flaking is not readily avoidable during this process opening and closing the core joint, but ideally is minimized. The presence of flakes can have broadened detriments to the operation of the transformer. Flakes interspersed between laminar layers can reduce the face-to-face contact of the laminations in a wound core, and thus reduce the overall operating efficiency of the transformer. Flakes and the site of a laced joint also reduces the face-to-face contact, reduces the overlap between mating joint sections and again reduces the overall operating efficiency of the transformer. This is particularly important in the locus of the laced joint as it is at this point that the greatest losses are expected to occur due to flaking. Containment methods are required to ensure that the broken flakes do not enter into the coils and create potential short circuit conditions between layers within the core. Stresses induced on the laminations during opening and closing of the core joints oftentimes causes a permanent increase of the core loss and exciting power in the completed transformer, as well as permanent reductions in operating efficiency of the transformer.

Thus, it would be particularly advantageous to provide an amorphous metal core which inherently features a reduced likelihood of lamination breakage which may occur during the assembly of a power transformer.

It would also be particularly advantageous to provide an amorphous metal core which inherently features reduced stress conditions within the wound, and laminated amorphous metal core, particularly three-limbed amorphous metal cores suited for use in three-phase transformers.

BRIEF DESCRIPTION OF DRAWINGS

The invention will be more fully understood and further advantages will become apparent when reference is had to the following detailed description and the accompanying drawings, in which.

SUMMARY OF THE INVENTION

According to one aspect of the invention, there is provided an amorphous metal core for a transformer which inherently features a reduced likelihood of lamination breakage which may occur during an assembly of a transformer.

In a second aspect of the invention, there is provided a 3-limbed amorphous metal core, particularly suited for inclusion within a three-phase transformer.

In a further embodiment of the invention there is provided a three-phase transformer which includes a 3-limbed amorphous metal core which feature reduced core losses.

In a yet further embodiment of the invention, there is provided a process for the assembly or manufacture of a 3-limbed amorphous metal core which is particularly suited for inclusion within a three-phase transformer.

In a still further aspect of the invention, there is provided an improved method for the manufacture of three-phase transformers which 3-limbed amorphous metal cores, which results in reduced core losses, as well as reduced assembly steps and/or assembly times.

DETAILED DESCRIPTION AND PREFERRED EMBODIMENTS

Figure 1:
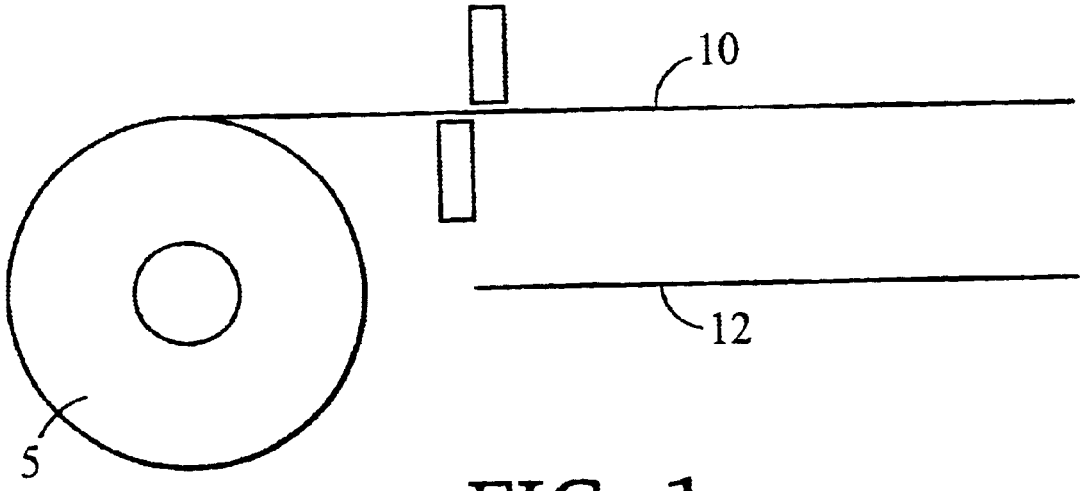
FIG. 1 is a side view of a wound reel on which is housed an amorphous metal strip appointed to be cut into a group of strips.
Figure 2:
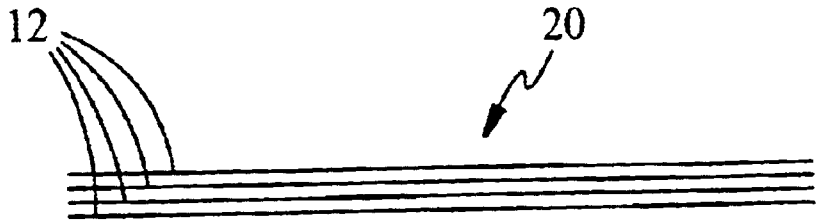
FIG. 2 is a side view of a cut group comprised of a plurality of layers of amorphous metal strip.

With regard to FIG. 1 therein is illustrated a side view of a wound reel 5 on which is housed an amorphous metal strip 10 appointed to be cut into strip segments 12. These strip segments 12 are later layered in register so to form groups 20 of amorphous metal strips. This is more clearly illustrated on FIG. 2 which is a representative side view of a group 20 of amorphous metal strips. As can be seen from FIG. 2, each of the individual strip segments 12 forming the group 20 has a length approximately equal to the lengths of the other strip segments 12. The specific number of individual strip segments 12 comprising each of the groups 20 is not necessarily a critical parameter, but it is to be understood that several technical considerations exist including the thickness of each of the strip segments 12, the flexural properties of each, as well as the ultimate final dimensions of the amorphous metal wound cores to be formed. Thus, while only four separate strip segments 12 are illustrated in FIG. 2, it is to be understood that greater or lesser numbers of strip segments 12 will comprise each of the groups 20.

Figure 3:
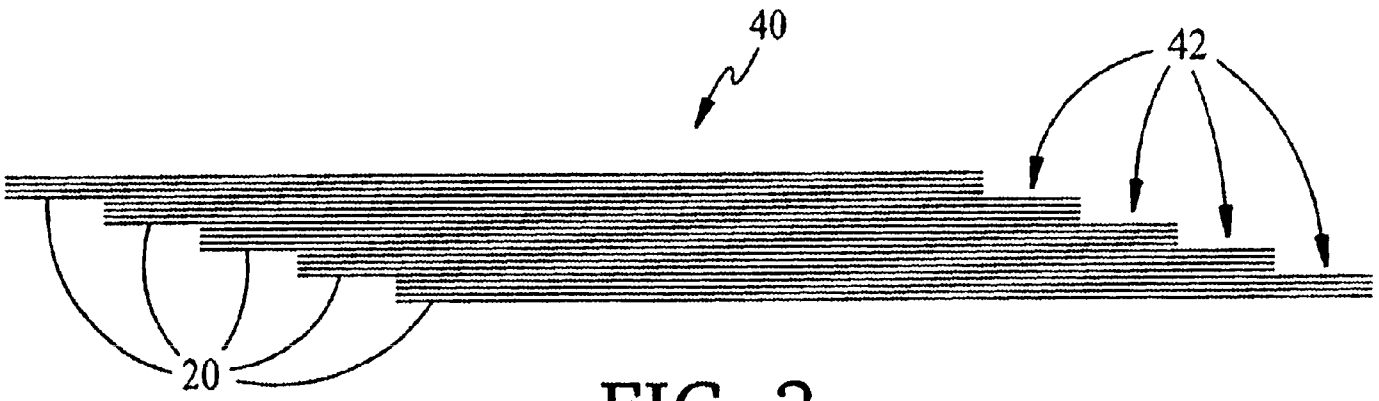
FIG. 3 is a side view of a packet comprising a predetermined number of cut groups, each group being staggered to provide an indexed step lap relative to the group immediately below it.

Turning now to FIG. 3 therein is shown in a side view a packet 40 comprised of a plurality of groups 20. Typically the number of the groups 20 is predetermined with reference to thickness of each of the strip segments 12, the flexural properties of each, as well as the ultimate final dimensions of the amorphous metal wound cores to be formed, it only being required that the number and dimensions of each of the groups 20 be selected such that ultimately the 3-limbed amorphous metal transformer core can be assembled. In order to facilitate assembly of the 3-limbed amorphous metal transformer core, each of the groups 20 are layered in a relative position such that between any two adjacent groups 20 a step lap 42 is provided. More desirably, as is shown on FIG. 3 a plurality of step laps 42 are provided in each of the packets 40. As is readily seen from the figure, each group 20 is staggered to provide an indexed step lap relative to the immediately adjacent group 20. With regard to the relative dimensions of each of the step laps this is not always critical to the success of the instant invention, but it is to be understood that several technical considerations exist including, but not limited to, the thickness of each of the strip segments 12, the flexural properties of each particularly subsequent to annealing, as well as the ultimate final dimensions of the amorphous metal wound cores to be formed from the packet 40. Further, as will be explained in more detail below, the dimensions of the individual groups 20, and their relative arrangement in each of the packets 40 are selected such that indexed mating joints are ultimately formed when the amorphous metal wound cores to be formed from the packet 40 are assembled.

Figure 4:
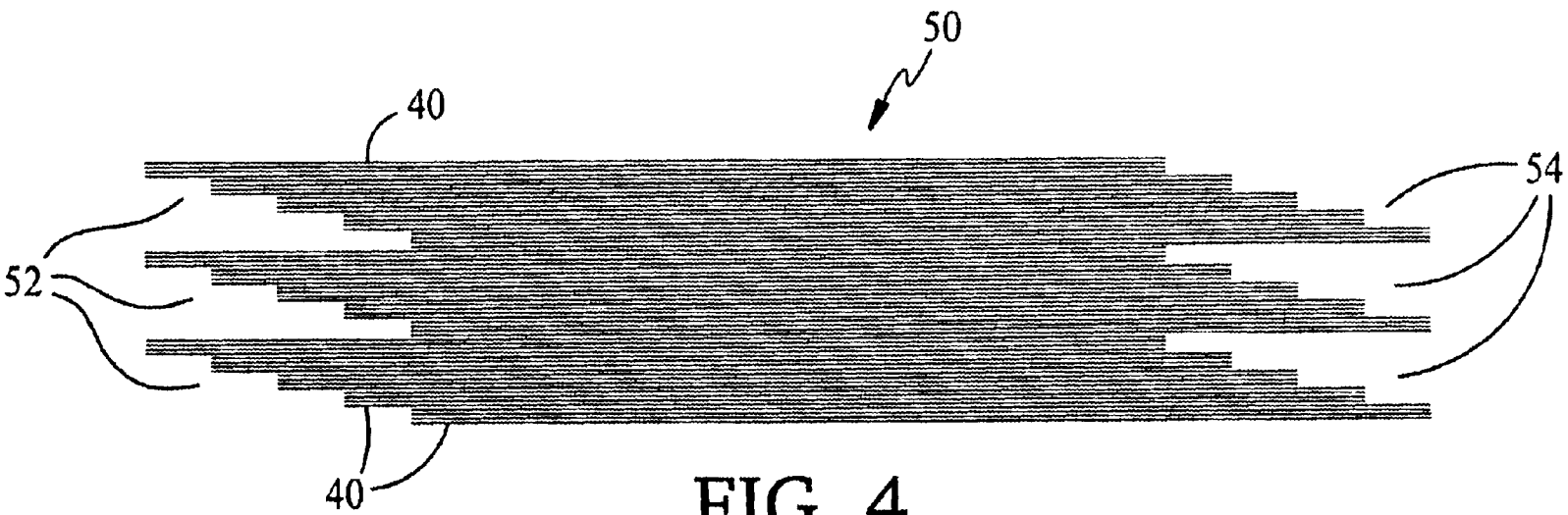
FIG. 4 is a side view of a core segment comprising a plurality of packets, an overlap joint and an underlap joint.

FIG. 4 illustrates in a side view of a core segment 50 comprising a plurality of packets 40. Here, three packets 40 are depicted but it contemplated that greater or lesser number of packets may also be used to form a core segment 50. As can be seen from FIG. 4 the three packets 40 are layered in register such that at one end, three overlap joints 52 are formed, each seen as an inverted "stair-stepped" pattern formed of the individual step laps 42 of each of the packets 40. At the opposite end of each of these three packets, three underlap 54 joints are formed, each visible as a "stair-stepped" patter which is formed of the individual step laps 42 of each of the packets 40. In FIG. 4, the groups 20 are arranged such that the step lap 42 pattern is repeated within each of the packets 40, and the packets 40 themselves are arranged to form repeated step lap pattern of the core segment 50. While the embodiment illustrated on FIG. 4 depicts one preferred embodiment of the present invention, it is to be understood that the number of step-laps in each packet 40 as well as in the core segment 50 could be the same or different than those shown in the figure. Likewise, the patterns of the overlap joints 52, 54 may also vary within each packet 40 as well as in each core segment 50. It is not essential to the present invention that a "stair-stepped" pattern be present, rather, it is to be understood that any arrangement of packets 40 may be used which packets 40 form indexed joints and which arrangement of packets 40 and core segment 50 in order to provide the required number of packets to meet the build specifications of the amorphous metal core segment. One alternative pattern for the overlapped joints 52, 54 is that instead of having the opposite ends of a group 20, but when the joint is laced, to rather form an overlap such as the ends of one group will overlap with its other end when the joint is laced. This technique can be repeated for each of the groups, as well as for each of the packets used to form a wound amorphous metal transformer core.

Figure 5:
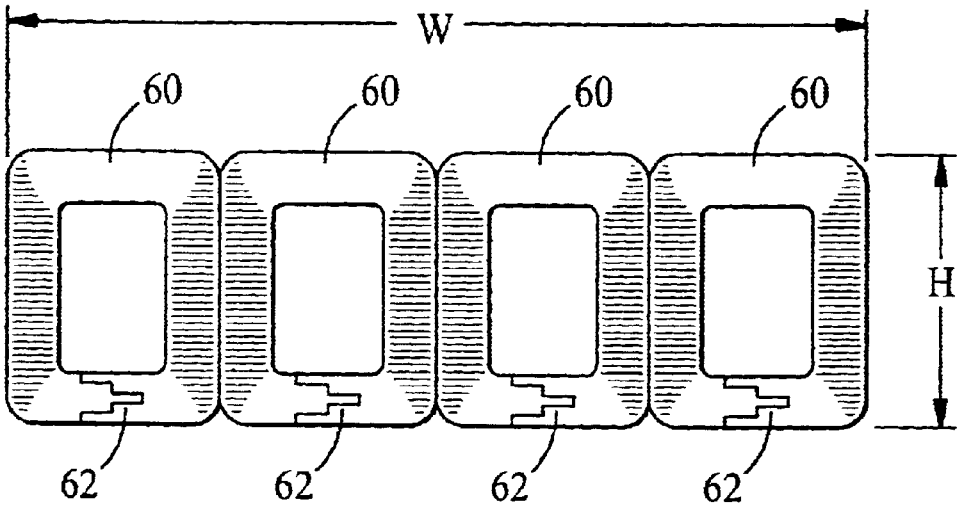
FIG. 5 (Prior Art)
FIG. 5 depicts a 5-limbed transformer core according to the prior art.

Certain benefits of the present invention will now be presented with respect to certain limitations inherent from the prior art. Turning now to FIG. 5 therein is shown a 5-limbed transformer core according to the prior art. As can be seen from FIG. 5, the 5-limbed transformer comprises four core sections 60, each substantially identical to the other. As is depicted in this side view, each of the cores is substantially rectangular in construction and are intended to represent wound metal cores. Further depicted on each of the cores are a series of joints 62 which, although shown on the drawing include a number of overlaps and underlaps, can be essentially of any other configuration, it being required only that each of the wound cores can be reassembled.

A significant shortcoming which is inherent in the art and is represented by the core assembly of FIG. 5 lies in the fact that typically, wherein such cores are produced of metals and in particular, of amorphous metals, as it is required that during the annealing step a magnetic field is placed about each of the cores. According to known-art processes, each individual core is first assembled, then annealed under appropriate temperature and time conditions in the presence of a magnetic field, after which it is allowed to cool. Typically, each of the individual cores 60 are individually annealed and it is only subsequently that each of the individual cores 60 are assembled. A significant technical problem which is inherent in such 5-limbed amorphous metal cores lies in the final configuration of a transformer which utilizes said transformer core. As can be seen in the drawing, the relative proportions necessarily result in a transformer which has a rather large width ("w") to height ("h") ratio. This aspect inherently results due to the fact that wherein a three-phase transformer is required, multiple legs are necessarily required. As has been discussed earlier, this in turn requires the assembly of a series of cores 60 which had been individually annealed as it has not been possible to first assemble the transformer core such as depicted in FIG. 5 and then subsequently in one process step anneal the entire transformer core in the presence of a single magnetic field. Naturally, the resultant dimensions of the 5-limbed transformer inherently require larger space necessary for the installation of any prior art transformer which utilizes this 5-limbed transformer design. Naturally, in many instances where space is at a premium, such a 5-limbed transformer cannot be utilized.

A further shortcoming which is not apparent from FIG. 5, but which will nonetheless be understood by skilled practitioners in this relevant art lies in the fact that it is known that uniform and consistent magnetic fields, as well as time and temperature variables should be uniformly maintained or transformer cores which are to be assembled into a finished transformer. Differences, often even slight differences between the time and/or temperature conditions which a coil subjected to under annealing as well as variations in the magnetic field which are applied to the core during the annealing process can have a noticeable and often deleterious impact on the operating characteristics of the resultant annealed transformer core. In order for the five-limbed transformer according to prior art to operate under optimal conditions, it would be required that each of the four wound transformer cores used to assemble the finished transformer having this configuration be subjected to identical magnetic fields as well as time/temperature conditions during the annealing stage. This is generally impractical, if indeed not impossible, in the present day. Such difficulties which do not permit such consistent annealing conditions include known variables including geometries of ovens, variations in the windings or power used to excite magnetic fields, as well as others not particularly elucidated here. These variations in the annealing of the individual cores result in variations in the resultant magnetic properties which will vary from wound core to wound core. Thus, when the multiple wound transformer cores are assembled into the five-limbed transformer, variations between the cores will result in an overall operating loss. Again, such operating losses are to be avoided wherever possible.

Many of the shortcomings inherent in such a prior-art 5-limbed transformer core are surprisingly and successfully addressed and overcome by the 3-limbed amorphous metal transformer core as well as other by aspects of the present invention.

Figure 6:
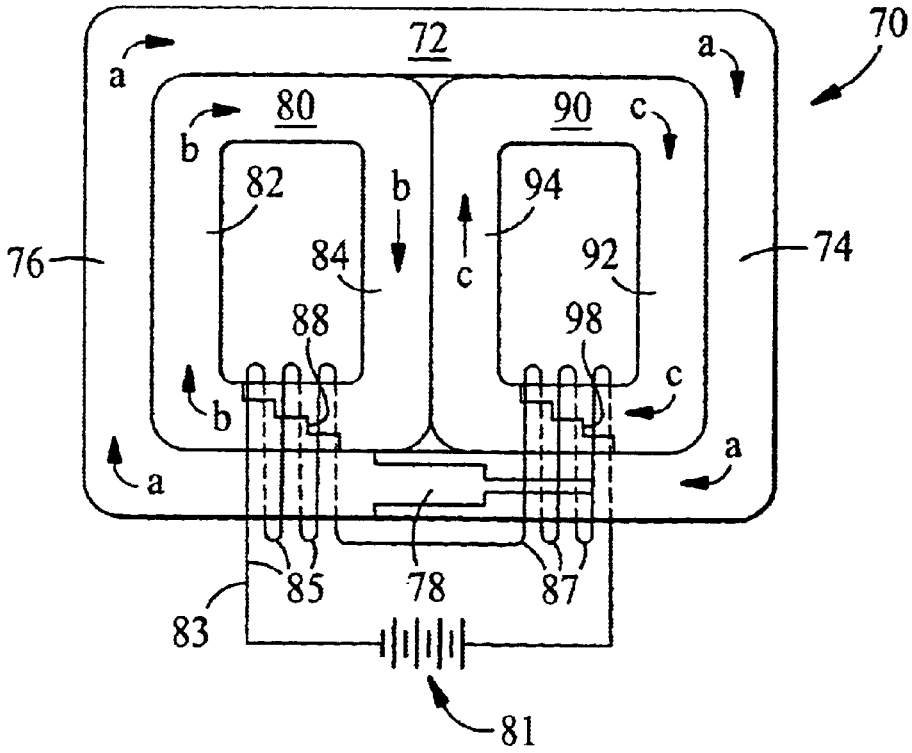
FIG. 6 depicts a 3-limbed amorphous metal transformer core according to the invention.

Turning to FIG. 6 therein is depicted a 3-limbed amorphous metal transformer core 70 according to the invention in an assembled state. As can be seen from FIG. 6 in this side view, the 3-limbed amorphous metal core 70 is comprised of three core sections, an outer core section 72 which encases two inner core sections 80, 90. With regard to the outer core section, it is seen that it has dimensions which are suitable for accommodating within its interior 74, the two core sections 80, 90 such the side legs of the outer core 74, 76 abut at least one side leg 82, 92 of the respective inner cores. Similarly, the inner cores 80, 90 also each include one leg 84, 94 which abut one another, but which do not abut any leg of the outer core 72. As can also be seen from FIG. 6, each of the core segments 72, 80, 90 each include a laced joint 78, 88, 98. As a closer review of FIG. 6 will reveal, the laced joint 78 of the outer core 72 has a configuration of overlapping and underlapping joints which contrasts with the stair-like joints 88, 98 of the two inner cores 80, 90. While a particular configuration for the joints have been depicted in FIG. 6, it is nevertheless to be understood that any other configuration whereby a joint may be laced and unlaced in order to permit for the insertion upon the legs of a coil assembly can also be utilized. Such expressly includes offset lap jointing wherein the two ends of a group or packet do not abut, but have overlapping ends. Also, it is significant to point out that according to particular preferred embodiments of the present invention as depicted in FIG. 6, each of the core segments 72, 80, and 90 include only one laceable joint. This contrasts and distinguishes the construction of the 3-limbed amorphous metal cores described herein with certain of those illustrated in the prior art and in particular with that depicted as FIG. 9 of currently copending U.S. Ser. No. 08/918,194. This distinction is not to be underestimated and, indeed, provides one of the benefits of the invention. As had been noted above, a significant problem inherent in the production of transformer cores from annealed amorphous metal components lies in the risk of breakage of flaking of the amorphous metal strips, which in turn introduce core losses. Such breakage and flaking of the amorphous metal strips is, however, difficult to avoid due to the inherent brittleness which is imparted to the amorphous metal subsequent to the annealing process. Naturally, the minimization of the number of joints and, in particular, also the minimization of the assembly steps required to produce a transformer from such amorphous metal cores would be highly desired as such would decrease the likelihood of core breakage or flaking of the amorphous metal strips which, in turn, would be minimize core losses, as well as the likelihood of internal short circuiting of the wound amorphous metal cores. In copending U.S. Ser. No. 08/918,194 many of these problems were overcome due to the production of individual core segments, including "C-type", "I-type" and straight core segments which were individually annealed and thereafter subsequently assembled into transformer cores. It can be seen from copending U.S. Ser. No. 08/918,194 a minimum of at least two joints were required to produce a transformer core. When methods of the present invention are practiced utilizing the C-type, I-type and straight core segments such as described in U.S. Ser. No. 08/918,194, improved transformer cores can be made. This is realized when, prior to any annealing step, appropriate C-type, I-type and straight core segments are assembled to form a transformer core, which is subsequently subjected to a magnetic field and appropriately annealed. The use of C-type, I-type and straight core segments are particularly advantageous in that a variety of various transformer configurations can be made. Yet, unlike the production steps recited in U.S. Ser. No. 08/918,194 wherein it is contemplated originally that each of these individual segments are first annealed under a magnetic field, and thereafter subsequently assembled according to the present invention assembly is first done and only thereafter is annealing on a magnetic field performed. An important advantage in such process is that according to the processes of U.S. Ser. No. 08/918,194, there was not any significant potential for reduced flaking or breakage of the joints as a multiplicity of joints needed to be laced together subsequent to annealing. Annealed amorphous metal is particularly brittle and difficult to handle particularly during the manual relacing application which is necessary to fabricate a transformer. According to the processes according to the present invention, while the amorphous metal is yet in an un-annealed state and is flexible, the transformer core is assembled and only subsequently annealed. Thereafter, only a minimum number of joints need to be unlaced in order to permit the insertion of appropriately sized and dimensioned transformer coils and the opened joints, relaced to reconstitute the transformer core. According to certain particularly advantageous embodiments one or more of the transformer cores present in the transformer cores of the present invention comprise only one laceable joint.

While more than one joint can be present in the transformer cores of the present invention, however, it has been advantageously found that according to the practice of the present invention, 3-limbed amorphous metal transformer cores particularly suitable for the production of three-phase power transformers can be produced with a reduced number of core joints for each of the cores, especially those having but one joint per core.

According to a further aspect of the present invention, there is provided a process for the manufacture of 3-limbed amorphous transformer cores which are particularly adapted to be used in three-phase power transformers. According to this process, there is provided a suitably dimensioned outer core encasing two inner amorphous metal cores such as generally described with reference to FIG. 6. However, neither the amorphous metal core, nor the individual amorphous metal strips which have yet been subjected to an annealing process prior to assembly into a core. Subsequent to the assembly of the amorphous metal transformer core such as depicted in FIG. 6, a first magnetic field is applied to a first side limb which (defined by the side legs 76 of the outer core 72 and the abutting leg 82 of the first inner core), and a second magnetic field is applied to a second limb of the transformer core 70 (defined by the other side leg 74 of the outer core 72 and the abutting side 92 of the other inner core 90) and under the presence of these two magnetic fields subjecting the assembled 3-limbed amorphous metal core to appropriate time and temperature conditions in order to appropriately anneal the amorphous metal strips contained therein while the transformer core is in an assembled state. Thereafter, the 3-limbed amorphous metal core is allowed to cool.

In a further aspect of the invention, the thus produced 3-limbed amorphous metal transformer core can be utilized in the manufacture of a power transformer. According to this aspect, the annealed amorphous metal transformer core produced as described above is then unlaced at the respective joint of each of the three cores, and subsequently, appropriately dimensioned transformer coils are provided onto each of the limbs, and thereafter the joints are relaced to reconstitute the transformer core.

The present inventors had unexpectedly found that the manufacturing method described above could be successfully practiced; heretofore it was not expected that appropriate magnetization of the amorphous metal during the annealing process could be achieved wherein such a 3-limbed amorphous metal transformer core were completely assembled during the annealing step. Surprisingly, in accordance with the configuration described herein, and in particular, the preferred configuration as depicted in FIG. 6, it was found that effective magnetization of the field during the annealing process could be imparted to the already assembled 3-limbed amorphous metal core.

Turning now to FIG. 6, there is depicted a three-limbed amorphous metal transformer core 70 in a laced condition. The figure also illustrates the condition of the core 70 while it is magnetized during the annealing treatment step. As depicted in FIG. 6, therein are provided a first 80 inner core laced at joint 88 and a second 90 inner core laced at joint 98. Both are encompassed by the outer core 74 which is laced at joint 78. A DC current source 81 is also represented having a continuous looped wire 83 attached to the positive and negative poles of the DC current source 81. Portions of the loop wire form turns about portions of the inner and outer cores of the core 70 as illustrated in FIG. 6. As can be seen, this wire forms a first set of windings 85 simultaneously about a portion of the first 80 inner core and the outer core, and a second set of windings 87 simultaneously about the second 90 inner core and the outer core 72. According to preferred embodiments of the invention, the number of windings can be different than those depicted in FIG. 6, but under preferred circumstances the number of first set of windings 85 and the second set of windings 87 are equal in number. This quality ensures that a uniform magnetic field is applied to both the inner and outer cores of the transformers during the annealing operation. Also, it is realized that any appropriate power supply or DC current source can be used in place of the DC current source 81 illustrated in FIG. 6.

Under the conditions shown, the present inventors have surprisingly found that appropriate magnetic fields are generated within the cores 72, 80, 90 while the windings 85, 87 are appropriately energized. The directions of the fields which result are illustrated in the figure wherein the arrows "a" represent the direction of the magnetic field in the outer core 72, arrows "b" represent the magnetic field direction in the first 80 inner core, while the arrows "c" represent the direction of the magnetic field in the second 90 inner core. As can be understood from FIG. 6, the direction of these magnetic fields are co-current throughout the transformer core 70 during the annealing operation. It is observed that only the directions in the third inner limb defined by 84, 94 are countercurrent. Nevertheless, it has been observed by the inventors that these countercurrent magnetic fields are not unduly deleterious to the overall final operating characteristics of the amorphous metal cores.

This significant and surprising result now provides for the possibility of the manufacture of amorphous metal cores which are pre-assembled, subsequently annealed, and then unlaced in order to admit appropriately dimensioned transformer coils. Such provides for a reduced number of handling steps, and in certain preferred embodiments, a reduced number of joints as well which are required to produce such transformer cores. In accordance with a particular preferred embodiment as depicted in FIG. 6, it can be seen that only one joint is required in each of the transformer cores. This is in contrast to many of the amorphous metal transformer constructions known in the art, and indeed can be contrasted with those depicted in copending U.S. Ser. No. 08/918,194. As can be seen from the description and drawings in U.S. Ser. No. 08/918,194, a minimum of two joints are required in each transformer core. While transformer core constructions an assemblage such as depicted in U.S. Ser. No. 08/918,194 can also benefit from the principles of the present invention as each of the individual sections can be assembled in an unannealed state into the form of a transformer core, and then subsequently magnetized and annealed in one step, and then later be disassembled in order to include transformer coils and thereafter reassembled into a completed transformer, the embodiment such as depicted in FIG. 6 provides an even further improvement thereover.

Figure 7:
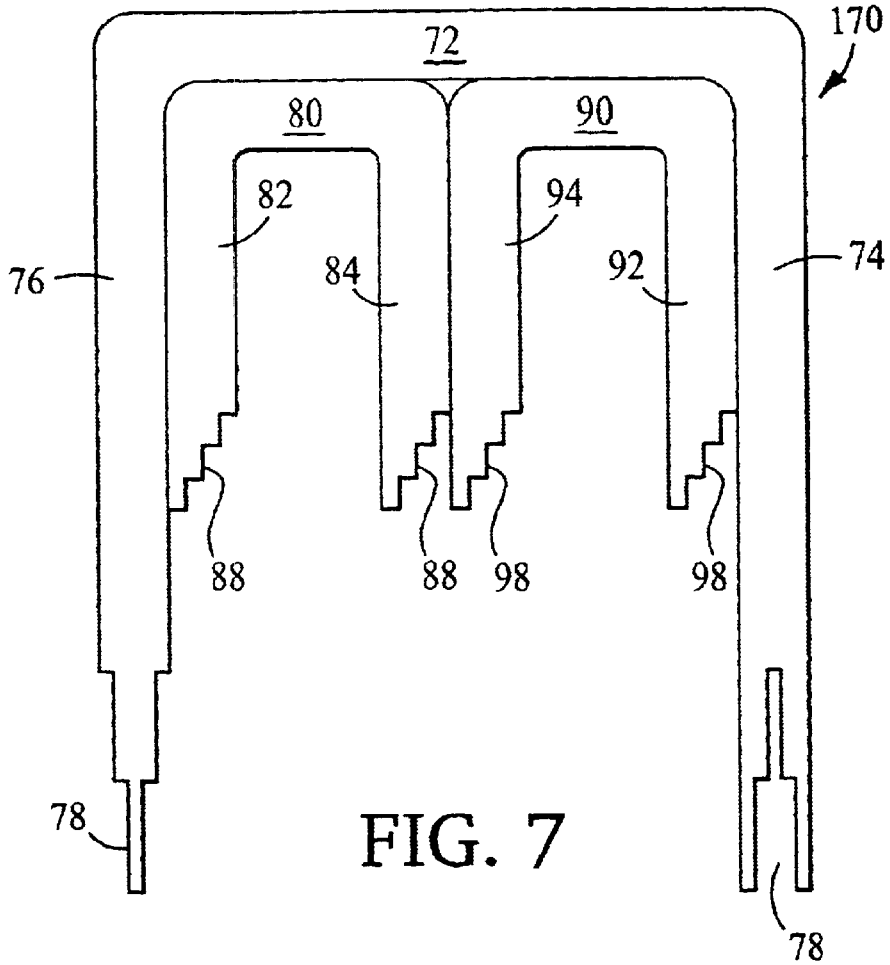
FIG. 7 illustrates the 3-limbed amorphous metal transformer core of FIG. 6 in an unlaced condition.

FIG. 7 illustrates the 3-limbed amorphous metal transformer core of FIG. 6 in an unlaced condition. As can be seen from FIG. 7, the corresponding portions of the outer core 74 making up the joint 78, as well as the corresponding portions of 88, 90 of the said first 80 and second 90 inner cores are depicted in a configuration adapted to permit for the insertion of three appropriately dimensioned magnetic coils (not shown in FIG. 7) onto the three limbs, namely a first outer limb defined by 76, 82 and a second outer limb defined by 74, 92 and the third inner limb defined by 84, 94. Thereafter, the joints 78, 88, 98 are respectively laced in order to close each of the respective cores 74, 80, 90.

As can be envisioned from the foregoing description, it is readily to be appreciated that during the manufacture of this preferred embodiment of a 3-limbed amorphous metal transformer core, each of the transformer cores need to be unlaced and relaced only once. As will be appreciated, such minimizes the amount of handling and assembly time required which is particularly pertinent from a labor and handling standpoint. Perhaps is even more pertinent is the reduced likelihood of breakage or flaking of the embrittled annealed amorphous metal, which consequently reduces the likelihood of core losses as well as reduced losses of amorphous metal within a joint. In contrast, many prior art techniques where additional handling steps are required due to the annealing of individual portions or individual cores of amorphous metal transformers which then need be assembled prior to the final unlacing in order to permit the insertion of appropriate transformer coils and subsequent final relacing, many of these additional assembly steps are reduced or eliminated by the present invention.

Figure 8:
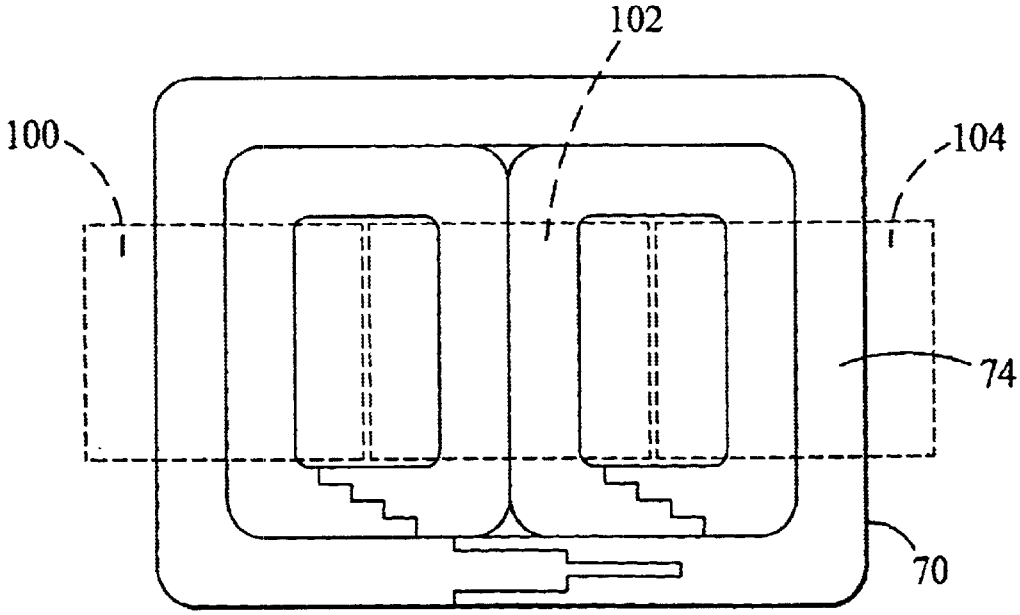
FIG. 8 depicts the 3-limbed amorphous metal transformer core of FIG. 6 in a laced condition as well as further depicting the placement of transformer coils.

Turning now to FIG. 8, therein is depicted the 3-limbed amorphous metal transformer core of FIG. 6 in a laced condition as well as further depicting the placement of transformer coils 100, 102, 104 (depicted by dashed lines). As can be seen from FIG. 8, each of the transformer coils 100, 102, 104 are appropriately sized, with the first transformer coil 100 having passing there through a first outer limb, a further transformer coil 104 having passing there through a second outer limb, while a third transformer coil 102 has passing there through the inner limb of the 3-limbed amorphous metal transformer core.

As has been discussed previously, it is to be understood that while a particular preferred embodiment of the invention are described essentially in accordance with FIGS. 6, 7 and 8, nonetheless the principles of the present invention can be used in the manufacture of other amorphous metal transformer cores and in the manufacture of transformers, which may include such cores. It is envisioned that the techniques described herein may be used in other multi-cored amorphous metal transformer core configurations as well.

Figure 9:
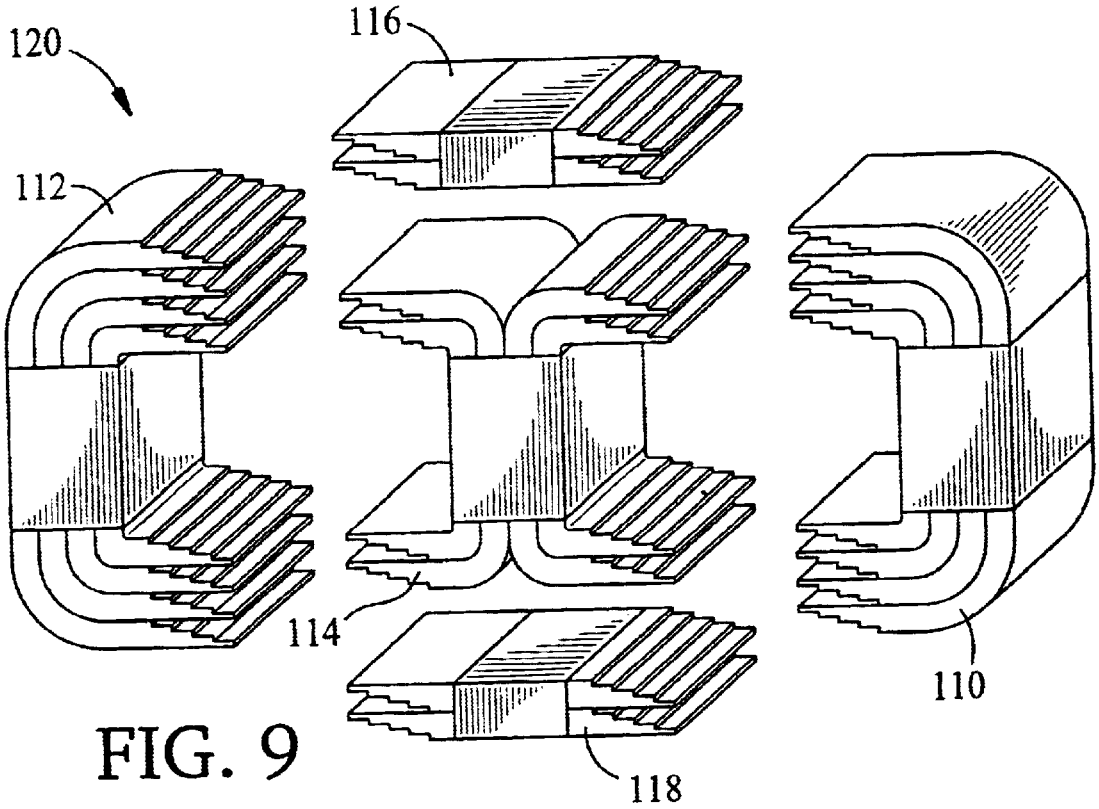
FIG. 9 illustrates in a perspective, separated view a further embodiment of a 3-limbed amorphous metal transformer core according to the invention which is comprised of discrete sections.

FIG. 9 illustrates in a perspective, separated view a further embodiment of a 3-limbed amorphous metal transformer core 120 according to the invention which is comprised of discrete sections. These discrete sections include a first C-section 110, a second C-section 112, an inner I-section 114, a first straight section 116 and a second straight section 118. As depicted in FIG. 9, each of these sections include a plurality of joints which are appropriately and correspondingly dimensioned so to complement a mating joint or at least a portion thereof of a different C-section, I-section or straight section.

Figure 10:
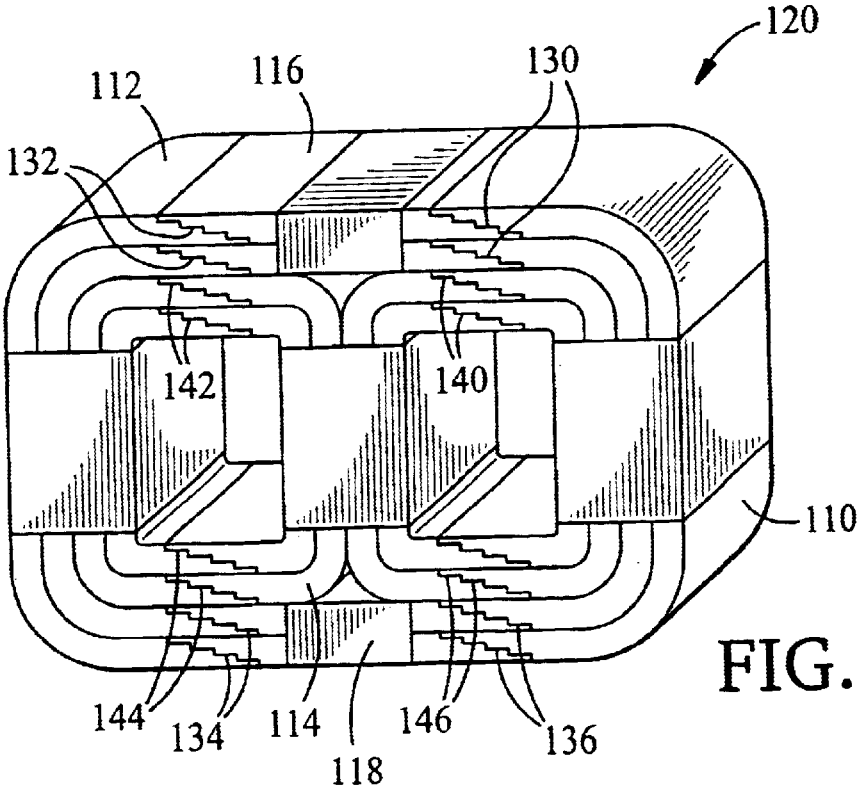
FIG. 10 depicts in a perspective view the assembled 3-limbed amorphous metal transformer core of FIG. 9.

With respect now to FIG. 10 therein is illustrated in a perspective view the assembled 3-limbed amorphous metal transformer core 120 of FIG. 9. As can be seen by inspection of FIG. 10, the assembled transformer core 120 includes an outer core comprised of sections of the first C-section 110, the second C-section 112, the first straight-section 116 and the second straight-section 118 wherein each of these aforementioned sections are joined by corresponding mating joints 130, 132, 134, 136. The 3-limbed amorphous metal transformer core 120 also includes an inner core section comprised of a portion of the first C-section 110 and a portion of the I-section 114, as well as a second inner core section comprised of a portion of the second C-section 112 and a further portion of the I-section 114. Each of these aforesaid sections are also mated at corresponding joints 140, 142, 144, 146, between the corresponding sections. According to this embodiment of the invention depicted in FIGS. 9 and 10, it is contemplated that the 3-limbed amorphous metal transformer core 120 is first assembled, is subsequently subjected to two magnetic fields under appropriate time and temperature conditions wherein annealing of the assembled amorphous metal transformer core 120 is realized. In accordance with a further aspect of the invention, one or more of the joints 130, 132, 134, 136, 140, 142, 144, 146 maybe unlaced in order to permit the insertion of appropriately dimensioned transformer coils about one or more of the limbs of the 3-limbed amorphous metal transformer core 120 and subsequently relaced in order to reconstitute the outer and inner cores. Advantageously, only a minimum number of joints within each respective core is unlaced to permit the insertion of the transformer coils, and then relaced to reconstitute each respective core. For example, according to one method joints 132 and 116 as well as joints 142 and 140 would be unlaced to permit the insertion of transformer coils. Alternately only one joint 140, 142 of each of the inner cores would be unlaced, while two abutting joints 130, 132 of the outer core would also be unlaced in order to permit the insertion of transformer coils. It is, of course, to be understood that these joints may be of any appropriate configuration, including abutting stair-step joints, or offset lap jointing as discussed previously. In any case, however, it is to be understood that in contrast to the techniques described in copending U.S. Ser. No. 08/918,194, the one-step magnetization and annealing process of the pre-assembled transformer core is practiced, as opposed to the magnetization and annealing of the discreet sections which are ultimately used to assemble a transformer core is described in U.S. Ser. No. 08/918,194.

Figure 11:
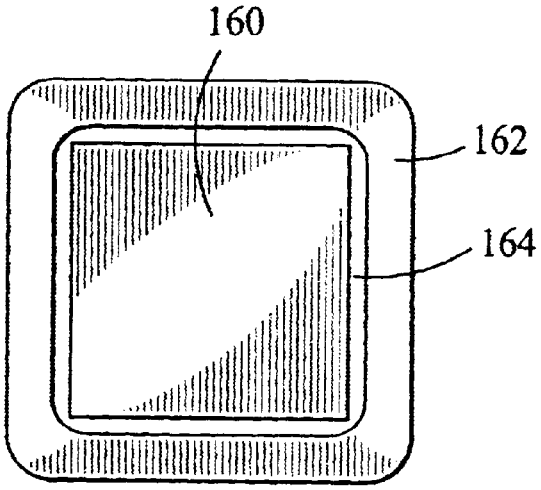
FIG. 11 depicts a cross-sectional view of a portion of a 3-limbed amorphous metal transformer core according to the invention.

FIG. 11 depicts a cross-sectional view of a portion of a 3-limbed amorphous metal transformer core according to the invention. As can be seen from FIG. 11, the 3-limbed amorphous metal transformer cores according to the invention can be based upon a variety of geometric configurations of both the core and the coil sections. As shown in FIG. 11, the core 160 is generally rectangular, and almost square in cross-section while the appropriately dimensioned transformer coil has a cross section having an interior space 164 which is appropriately dimensioned to receive the transformer core 160. According to FIG. 11, this interior space is also generally rectangular in cross-section, and it is expected that it would be suitably dimensioned so to minimize the clearance or air gap between the core and the coil thereby providing a more efficiently packed transformer.

Figure 12:
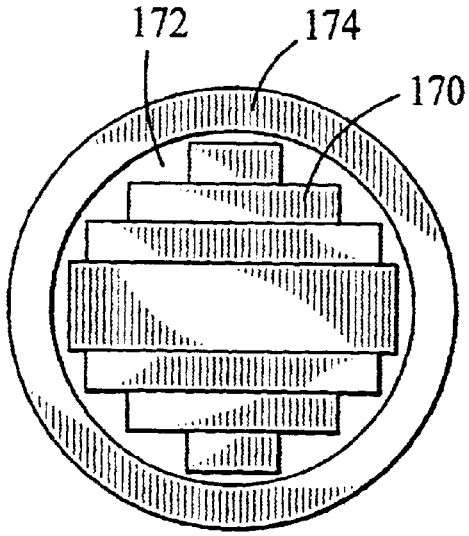
FIG. 12 depicts a cross-sectional view of a further embodiment of a portion of a 3-limbed amorphous metal transformer core according to the invention.

FIG. 12 depicts a cross-sectional view of a further embodiment of a portion of a 3-limbed amorphous metal transformer core according to the invention. In the alternative embodiment, there is depicted a transformer core 170 which has a cruciform cross-section. The cruciform cross-section is assembled from discreet packets or stacks of amorphous metal foil having varying widths, all of which are encased within the interior 172 of an appropriately dimensioned, generally circular transformer coil. As can be seen from this cross-sectional view, the coil is indeed hollow in its interior, and has an inner diameter which is suitably dimensioned to accommodate the cruciform-shaped amorphous metal transformer core.

Figure 13:
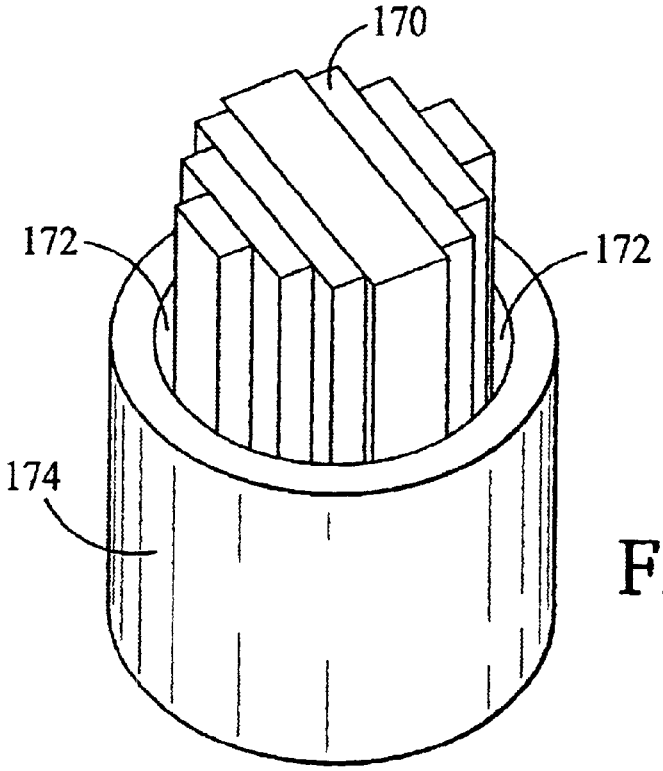
FIG. 13 depicts a perspective view of a 3-limbed amorphous metal transformer core according to FIG. 12.

Turning now to FIG. 13 therein is shown in a perspective view a 3-limbed amorphous metal transformer core according to FIG. 12. In this perspective view, the relative relationships between the cruciform-shaped amorphous metal core 170 and the generally circular transformer coil 174 can be seen. Again, it is intended that under ideal circumstances that the air gap 172 between the core 170 and the coil 174 be minimized so to improve the packing efficiency of the transformer of which the cores and coils form a part.

As to useful amorphous metals, generally stated, the amorphous metals suitable for use in the manufacture of wound, amorphous metal transformer cores can be any amorphous metal alloy which is at least 90% glassy, preferably at least 95% glassy, but most preferably is at least 98% glassy.

While a wide range of amorphous metal alloys may be used in the present invention, preferred alloys for use in amorphous metal transformer cores of the present invention are defined by the formula:

$$M_{70\text{-}85}Y_{5\text{-}20}Z_{0\text{-}20}$$

wherein the subscripts are in atom percent, "M" is at least one of Fe, Ni and Co. "Y" is at least one of B, C and P and "Z" is at least one of Si, Al and Ge; with the proviso that (i) up to 10 atom percent of component "M" can be replaced with at least one of the metallic species Ti, V, Cr, Mn, Cu, Zr, Nb, Mo, Ta and W, and (ii) up to 10 atom percent of components (Y+Z) can be replaced by at least one of the non-metallic species In, Sn, Sb and Pb. Such amorphous metal transformer cores are suitable for use in voltage conversion and energy storage applications for distribution frequencies of about 50 and 60 Hz as well as frequencies ranging up to the gigahertz range.

By way of non-limiting example, devices for which the transformer cores of the present invention are especially suited include voltage, current and pulse transformers; inductors for linear power supplies; switch mode power supplies; linear accelerators; power factor correction devices; automotive ignition coils; lamp ballasts; filters for EMI and RFI applications; magnetic amplifiers for switch mode power supplies; magnetic pulse compression devices, and the like. The transformer cores of the present invention may be used in devices having power ranges starting from about 5 kVA to about 50 MVA, preferably 200 kVA to 10 MVA. According to certain preferred embodiments, the transformer cores find use in large size transformers, such as power transformers, liquid-filled transformers, dry-type transformers, and the like, having operating ranges most preferably in the range of 200 KVA to 10 MVA. According to certain further preferred embodiments, the transformer cores according to the invention are wound amorphous metal transformer cores which have masses of at least 200 kg, preferably have masses of at least 300 kg, still more preferably have masses of at least 1000 kg, yet more preferably have masses of at least 2000 kg, and most preferably have masses in the range of about 2000 kg to about 25000 kg.

The application of the invention where the transformer cores are produced of amorphous metal alloys derive a great benefit from the present invention. As such amorphous metal alloys are typically only available in thin strips, ribbons or sheets ("plates") having a thickness generally not in excess of twenty five thousandths of an inch. These thin dimensions necessitate a greater number of individual laminar layers in an amorphous metal core and substantially complicates the assembly process, particularly when compared to transformer cores fabricated from silicon steel, which is typically approximately ten times thicker in similar application. Additionally, as will be appreciated to skilled practitioners in the art, subsequent to annealing, amorphous metals become substantially more brittle than in their unannealed state and mimic their glassy nature when stressed of flexed by easily fracturing. Due to the lack of long range crystalline order in annealed amorphous metals, the direction of breakage is also highly unpredictable and unlike more crystalline metals which can be expected to break along a fatigue line or point, an annealed amorphous metal frequently breaks into a multiplicity of parts, including troublesome flakes which are very deleterious as discussed herein.

Certain of the mechanical assembly steps required to manufacture the transformer cores as well as to produce transformers using the transformer cores according to the present invention include conventional techniques which may be known to the art, or may be as described in U.S. Ser. No. 08/918,194 as well as in co-pending U.S. Ser. No. 09/841,945 as well as in copending U.S. Ser. No. 09/841,833, now U.S. Pat. No. 6,583,707B2 the contents of which are herein incorporated by reference. Generally, in order to manufacture a transformer core from a continuous ribbon or strip of an amorphous metal, the cutting and stacking of laminated group 20 and packets 40 is carried out with a cut-to-length machine and stacking equipment capable of positioning and arranging the groups in the step-lap joint fashion. The cutting length increment is determined by the thickness of lamination grouping, the number of groups in each packet, and the required step lap spacing. Thereafter the cores, or (core segments such as depicted on FIGS. 9 and 10) may be shaped according to known techniques, such as bending the laminated groups 20 or packets 40 about a form such as a suitably dimensioned mandrel. Alternately the cores may also be produced utilizing a semi-automatic belt-nesting machine which feeds and wraps individual groups and packets onto a rotating arbor or manual pressing and forming of the core lamination from an annulus shape into the rectangular core shape.

Desirably, in order to facilitate the mechanical stability and handling of the cores or core segments the edges of the cores or core segments are coated or impregnated with an adhesive material, especially epoxy resins which aid in holding the laminated groups 20 or packets 40 together. Typically the application of such an adhesive material occurs subsequent to annealing of the transformer core or core segments. Frequently the use of bonding plates such as visible from FIGS. 9 and 10 may also be applied to the edges of the laminated groups 20 or packets 40 in order to provide further stiffening. Other techniques and other means, such as the use of wrapping or straps may also be used to stiffen the cores or core segments and retain their configuration prior to and during the annealing step of the process, although the use of epoxy resins subsequent to annealing, with or without bonding plates is preferred subsequent to annealing due to their easy application and good physical performance characteristic.

For certain particularly large transformers, the construction of the amorphous metal cores in accordance with the configurations and assembly techniques embodied on FIGS. 9 and 10, is often advantageous. However, it is to be understood that inventive principles taught herein are contemplated as being useful with other transformer core designs, including those which are not necessarily depicted in the accompanying figures.

The assembled transformer cores of the invention are annealed at suitable temperatures for sufficient time in order to reduce the internal stresses of the amorphous metal of the transformer core. As will be realized by skilled practitioners in the art the annealing temperature and time may vary, and in part depends upon various factors, such as the annealing oven, the operating temperature range of the oven, the annealing temperature selected, etc. Generally speaking it is required only that the time and temperature conditions be selected so to appreciably, preferably substantially reduce the internal stresses of the transformer core during the annealing process. Such a reduction in the internal stresses improves the performance characteristics of the transformer core and the ideal conditions may be determined by routine experimentation for a particular transformer core and available annealing conditions. Similarly it is also know that such internal stresses are reduced when the transformer core is subject to at least one magnetic field during the annealing process. Again the specific field strength and specific conditions may be determined by routine experimentation, as well as from currently known prior art annealing conditions, such as in one or more of the patents discussed above. Specific, and preferred conditions may be gleaned from the examples set forth below. Advantageously, by way of non-limiting example, the assembled transformer cores of the invention are annealed at temperatures of between 330°–380° C., but preferably at a temperature about 350° C. while being subjected to two magnetic fields. As is well known to those skilled in the art, the annealing step operates to relieve stress in the amorphous metal material, including stresses imparted during the casting, winding, cutting, lamination, arranging, forming and shaping steps.

EXAMPLES

The series of transformer cores proves both according to prior art techniques and according to the processes of the present invention were produced. Each of these cores were produced from an unannealed amorphous metal alloy strip (METGLAS 2605 SA1, either 142 mm or 170 mm wide strips).

Comparative Example 1

A five-limbed transformer as per FIG. 5 was produced. This transformer was produced by first fabricating four individual cores, each having one joint from an unannealed amorphous metal alloy strip (METGLAS 2605 SA1, 142 mm wide) according to known art techniques. Briefly, these individual cores were fabricated by first producing a series of cut strips, assembling them into appropriate packets, and then ultimately winding them around a suitably dimensions mandrel. The mandrel was then removed, leaving a core-window. Subsequently, each of the four individual cores were annealed at a temperature between 340–355° C. During the annealing process one turn of a wire was passed through each of the core windows and about a portion of each of the cores. A current of 700 amps, at approximately 4 volts DC was provided in order to induce a field within each of the individual cores during the annealing process. After reaching a temperature of between 340–355° C. the cores were retained in the oven for a further 30 minutes, ensuring thorough heating and annealing of each of the individual transformer cores. Subsequently, the cores were removed, allowed to cool, and thereafter assembled into a five-limbed transformer as per FIG. 5.

The cooled and assembled cores were placed on a non-electrically and non-magnetically conducting surface, and any assembly devices, such as C-claims, steel straps were removed. Thereafter the core losses were determined for the assembled annealed transformer core. This evaluation was done generally in accordance with the protocols outlined in Transformer Test Standard ASA C57–12.93—No Load Loss Measurement. Thirty turns of a test cable were wound per core leg, and test voltage was 91 VAC, which provided an operating induction of 1.3 Tesla. According to the ASA C57–12.93 test it was found that the five-limbed transformer exhibited a loss of 0.87 watts per kilogram based on the total mass of the five-limbed transformer core which was 156 kilograms.

Comparative Example 2

A second five-limbed transformer core was produced of the same materials and in accordance with the technique described above with reference to Comparative Example 1. A five-limbed transformer was ultimately assembled from individually annealed transformer cores which were exposed to the same thermal and magnetic conditions described above during the annealing process. Again, subsequent to annealing and cooling the core losses were evaluated in accordance with the technique discussed with reference to Comparative Example 1. It was found that the assembled five-limbed transformer core exhibited a core loss of 0.35 watts per kilogram and that the five-limbed transformer had a total mass of 156 kilograms.

Comparative Example 3

A three-limbed transformer core, according to FIG. 6 was produced by fabricating three individual cores, two inner cores and an outer core, each having one joint. These cores were produced from an unannealed amorphous metal alloy strip (METGLAS 2605 SA1, 142 mm wide) according to known art techniques. These three cores were then annealed by heating to a temperature of 340–355° C. and once this temperature was reached, they were allowed to remain at that temperature for 30 minutes to ensure thorough heating of each of the transformer cores. During this annealing process, a wire was wrapped through the core windows and about each of these individual cores through which passed a current of 700 amps at approximately 4 volts DC. This ensured that the same magnetic field was excited in each of the cores. Subsequently, the individual cores were removed from the oven and allowed to cool. The two inner cores were then assembled into the interior of the outer core to form a three-limbed transformer core having a total mass of 156 kilograms.

In accordance with the method described above with reference to Comparative Example 1, the core loss of this assembled three-limbed transformer core was determined according to ASA C57–12.93, with 30 windings of the test cable about each core leg and with the same power input being the same as described with reference to Comparative Example 1. According to this test, the core loss was determined to be 0.258 watts per kilogram. Subsequently, the joints in each of the three cores were opened, and then relaced to reconstitute these individual cores. Again, the core losses were evaluated according to the same method, and it was found that the core loss was now 0.284 watts per kilogram, demonstrated an increased core loss on the order of 10% attributable to the annealing and assembly process and the opening and closing of the joints.

Comparative Example 4

A second three-limbed transformer core according to FIG. 6 was produced in accordance with the method and from the same material described with reference to Comparative Example 3. The individual cores were produced, separately annealed under magnetic field conditions except and similar heating conditions which differed only in that the individual cores were allowed to reside at their temperature of 340–355° C. for 60 minutes, rather than 30 minutes as described with reference to the cores of Comparative Example 3.

Similarly, subsequent to cooling and assembly into a three-limbed transformer core which also had a mass of 156 kilograms, the magnetic losses were determined to be 0.87 watts per kilogram. Subsequently, as described previously, the joints in the cores were opened and subsequently these joints were relaced in order to reconstitute the three-limbed transformer core. Again, as described with reference to Comparative Example 3, the magnetic losses were evaluated and were determined to be 0.315 watts per kilogram, which demonstrated an increased core loss on the order of 9.7% which is attributable to the annealing and assembly process and the opening and closing of the joints.

Example 1

An amorphous metal transformer core produced according to the techniques according to the instant invention was produced.

A transformer core of the same size and configuration as that produced in Comparatives Examples 3 and 4 was produced. Two same-size inner cores were fabricated from an unannealed amorphous metal alloy strip (METGLAS 2605 SA1, 142 mm wide) according to known art techniques. These were inserted into a fabricated outer core. Subsequent to their assembly in their unannealed condition, this three-limbed transformer core was heated to a temperature of 340–355° C. in the presence of a magnetic field induced by two turns of a wire passing through each of the two core windows, as illustrated in FIG. 6. After being heated to the temperature described above, the subsequent residence time in the oven was 30 minutes in order to ensure thorough heating and annealing of this assembled the transformer core. During this annealing process, a wire was wrapped through the two core windows of the assembled three-limbed transformer through which passed a current of 700 amps at approximately 4 volts DC. This provided a field strength cores comparable to that provided in the cores according to Comparative Example 3 and Comparative Example 4. Thereafter, the assembled three-limbed transformer core was then removed from the oven and allowed to cool; the total mass of the annealed core was 156 kilograms.

In accordance with the protocol described above with reference to the methods described in Comparative Examples 3 and 4, this annealed core was then evaluated for core losses which were determined to be 0.25 watts per kilogram. Subsequently, the joint in each one of these three cores was opened, and thereafter the joints were relaced in order to reconstitute the three-limbed transformer. Thereafter, the magnetic core losses of this annealed three-limbed transformer core was again evaluated according to the same technique and it was found to be 0.264 watts per kilogram, an increase in core loss of only 2.33%.

Example 2

A second, three-limbed transformer core was produced from the same materials, and in accordance with the method described with reference to Example 1 above. This three-limbed transformer core, having a configuration as depicted on FIG. 6, was manufactured in accordance with process discussed in Example 1, above. Subsequent to attaining a temperature of 340–355° C. however the heated core was maintained within these temperatures for 60 minutes, 30 minutes longer than the three-limbed transformer core according to Example 1. During the annealing process a wire was wrapped through the two core windows of the assembled three-limbed transformer through which passed a current of 700 amps at approximately 4 volts DC. As with the other cores according to the Examples and Comparative Examples, subsequent to annealing in the presence of a magnetic field, the annealed core was remove and allowed to cool to room temperature (approx. 20° C.). Similarly using the protocol discussed with reference to Example 1, the core loss was determined to be 0.285 watts per kilogram, the total mass of the annealed core being 156 kg. Thereafter, the joint in each one of the three cores was opened, and subsequently relaced in order to reconstitute the annealed three-limbed transformer core. It was found that the core losses were 0.274 watts per kilogram. While it was unusual that the losses appeared to decrease subsequent to relacing of the joints, the magnitude of the differences between these two reported core loss values is still the difference of only 4.0%.

Comparative Example 5

A further, albeit heavier three-limbed transformer core was produced according to prior art techniques. This transformer was produced from individual cores having at least two or more joints. The construction and the elements of these three-limbed transformer cores was in accordance with the depictions of FIGS. 9 and 10. This transformer core was produced from unannealed amorphous metal alloy strip (METGLAS 2605 SA1, 170 mm wide) according to known art techniques.

According to the present Comparative Example, three cores, namely two similarly sized inner cores and a third outer core were assembled of appropriately sized and pre-assembled "C", "I" and "straight" sections.

Thereafter, these three cores were then introduced into an oven, and heated to a temperature of 340–355° C. in the presence of a magnetic field which is induced by two turns of wire wrapped through each of the three separate core windows. The current passing through the wire was 2100 amperes at approximately 5 volts DC. This ensured that a consistent magnetic field was induced in each of the three cores being annealed. Once the temperature was achieved, these three cores were allowed to remain in the oven for 60 minutes to ensure thorough annealing of each of the individual cores. Subsequently, these three cores are removed from the oven, and then assembled to form a three-limbed transformer core according to FIG. 10, which had a total mass of 1010 kilograms.

Subsequently, as described above with reference to Comparative Example 1, the core losses for this assembled three-limbed transformer core was evaluated, except that 203 volts (AC), were supplied to provide an operating induction of 1.3 Tesla, were attached to the ends of the test cable loops and the core loss measurement was observed on the power meter. It was determined that this three-limbed transformer core exhibited a core loss of 0.341 watts per kilogram. Thereafter, the two joints in the outer core, and one joint in each of the inner cores were opened. This simulated the handling requirements needed to permit the insertion of appropriately sized transformer coils about the legs of this three-limbed transformer core. Subsequent to these cores were relaced in order to reconstitute the three-limbed transformer core. Again, the core loss was evaluated under the same conditions. It was found that the transformer core now exhibited a core loss of 0.375 watts per kilogram, demonstrating an increased core loss on the order of 9.98% which is attributable to the annealing and assembly process and the opening and closing of the joints.

Comparative Example 6

A three-limbed transformer core of the same materials, and having the same configuration as that produced in Comparative Example 5 was produced.

Similarly, the three-limbed transformer core was fabricated by producing three separate suitably sized cores, viz., two inner cores, and one outer core were assembled of appropriately sized and pre-assembled "C", "I" and "straight" sections. These three individual cores were annealed by heating to 340–355° C., and thereafter allowing a further residence time of 60 minutes at this temperature to ensure thorough heating of each of these separate transformer cores. Concurrently an magnetic filed was imparted in the three separate coils by a wire looped through the core windows of the coils, through which passed a current of 2800 amperes at approximately 6 volts DC. Subsequently, these three cores are removed from the oven, and then assembled to form a three-limbed transformer core according to FIG. 10, which had a total mass of 1025 kilograms.

The magnetic losses of this annealed, three-limbed transformer core was evaluated and determined in accordance with the protocol outlined with reference to Comparative Example 5 to be 0.294 watts per kilogram. Thereafter, the two joints in the outer core, and one joint in each of the inner cores were opened. This simulated the handling requirements needed to permit the insertion of appropriately sized transformer coils about the legs of this three-limbed transformer core. Subsequent to these cores were relaced in order to reconstitute the three-limbed transformer core. Again, the core loss was reevaluated. It was found that the transformer core now exhibited a core loss of 0.323 watts per kilogram, demonstrating an increased core loss on the order of 9.8% which is attributable to the annealing and assembly process as well as the opening and closing of the joints.

Example 3

A three-limbed transformer core was produced according to process according to the present invention. This transformer core was produced from individual cores having at least two or more joints. The construction and the elements of these three-limbed transformer cores was in accordance with the depictions of FIGS. 9 and 10. This transformer core was produced from unannealed amorphous metal alloy strip (METGLAS 2605 SA1, 170 mm wide).

According to the present Example, three cores, namely two similarly sized inner cores and a third outer core were assembled of appropriately sized and pre-assembled "C", "I" and "straight" sections, and prior to annealing were assembled into a configuration depicted on FIG. 10.

Thereafter, this assembled three-limbed transformer core was introduced into a suitable oven, and raised to a temperature of 340–355° C. At the same time, a wire was looped through each of the two core windows, through which was passed a current of 2100 amperes, at approximately 5 volts DC. This ensures that a consistent magnetic field was excited in the transformer core. After reaching a temperature of 340–355° C., this assembled three-limbed transformer core was allowed to reside in the oven for 60 minutes to ensure thorough annealing of the amorphous metal.

Subsequently the three-limbed transformer core was removed from the oven, and in accordance with the techniques described above with reference to Comparative Examples 5 and 6, the core loss was determined to be 0.346 watts per kilogram, based on the total mass of 1002 kilograms. Thereafter, two core joints in the outer core, and one core joint in each one of the two inner cores was opened, and then subsequently relaced, simulating the handling steps which would be required in order to permit the insertion of appropriately sized transformer coils about each one of the legs. Subsequent to the relacing of each of these joints and reconstitution of the three-limbed transformer core, the cores were retested by the same technique and it was found that that the core losses were now 0.353 watts per kilogram demonstrating an increase in loss of only 2.0% attributable to the assembly and annealing process, and the opening and closing of the joints.

Example 4

A similar three-limbed transformer core to that described in Example 3 was produced using the same materials and according to the process of the present invention. A three-limbed transformer core having two inner cores and an outer core, totaling a mass of 1024 kilograms, was first assembled and thereinafter introduced into an oven. A wire was wrapped through each of the core windows, and a current of 2800 amperes, at approximately 6 volts DC was passed through the wire in order to excite a field in the assembled core, while it was being annealed. The three-limbed transformer core was heated to a temperature of 340–355° C., and reaching these temperatures, the transformer core was allowed to reside in the oven for 60 minutes to ensure thorough annealing of the amorphous metal.

Subsequently the three-limbed transformer core was removed from the oven, and in accordance with the techniques described with reference to Example 4, the core loss was determined to be 0.284 watts per kilogram. Thereafter, two core joints in the outer core, and one core joint in each one of the two inner cores was opened, and then relaced. Subsequent to the relacing of each of these joints and reconstitution of the three-limbed transformer core, it is determined that the core losses were now 0.305 watts per kilogram demonstrating an increase in core loss of only 7.3% attributable to the assembly and annealing process, and the opening and closing of the joints.

The benefits of the practice of the inventive process, and the transformer cores produced according to the process are evident when contrasted against the resultant magnetic core losses of similarly sized transformer cores. For example, the cores produced according to Comparative Example 3 and Example 1 are virtually identical in size and yet the cores produced according to the present invention have a better magnetic core loss by approximately 7.6%. Similarly improved results were also evident from Table 1 which also reports the benefits among similarly sized transformer cores.

TABLE 1

| Core: | Comp.1 | Comp.3 | Ex.1 | Comp.5 | Ex.3 |
|---|---|---|---|---|---|
| Core mass | 156 kg | 156 kg | 156 kg | 1010 kg | 1002 kg |
| Anneal soak time | 30 min | 30 min | 30 min | 60 min | 60 min |
| DC field amp total | 700 | 700 | 700 | 2100 | 2100 |
| DC field volt (approx) | 4 | 4 | 4 | 5 | 5 |
| Pre-joint opening core loss (Watt/kg) | 0.287 | 0.258 | 0.258 | 0.341 | 0.346 |
| Post-reassembly core loss (Watt/kg) | — | 0.284 | 0.264 | 0.375 | 0.353 |
| Relative core loss Improvement (%) | | | +7.95% | | +6.23% |
| **Core:** | **Comp.2** | **Comp.4** | **Ex.2** | **Comp.6** | **Ex.4** |
| Core weight | 156 kg | 156 kg | 156 kg | 1025 kg | 1024 kg |
| Anneal soak time | 60 min | 60 min | 60 min | 60 min | 60 min |
| DC field amp total | 700 | 700 | 700 | 2800 | 2800 |
| DC field volt (approx) | 4 | 4 | 4 | 6 | 6 |
| Pre-joint opening core loss (Watt/kg) | 0.335 | 0.287 | 0.285 | 0.294 | 0.284 |
| Post-reassembly core loss (Watt/kg) | — | 0.315 | 0.274 | 0.323 | 0.305 |
| Relative core loss Improvement (%) | | | +14.95% | | +5.90% |

The inventive process, transformer cores as well as transformers utilizing said transformer cores provide a valuable advance in the relevant art. With respect to the manufacture of transformer cores and transformers, the time required for unnecessary opening and closing the joint of the conventional wound core is eliminated. Handling requirements are reduced, and consequently core losses caused by breakage of the embrittled annealed amorphous metal used in the wound cores of the invention is noticeably decreased. Additionally, reduced handling requirements also provide for faster core and coil assembly time, improved core quality, and were the transformer core is produced from interchangeable transformer core segments, said segments can be to mixed and matched in order to optimize the performance of the finished transformer.

Further, the inventive transformer cores, as well as the processes used for producing transformers which incorporate the amorphous wound transformer cores described herein feature improved operating efficiencies due to a reduction in the flaked and/or broken amorphous metal particles subsequent to the assembly of a transformer. This is due to the fact that the transformer cores according to the invention may incorporate as little as a single joint within each transformer core which consequently provides a reduced likelihood of breakage and/or of flaking of the transformer joint when it is laced. This consequently diminishes the amount of flaky and/or breakage (as compared to two, three or even more joints within each core) and the release of flakes, and concomitant electrical shorting within the transformer core itself. As has been noted previously, flakes within the lap joint may cause interlaminar losses within the joint and reduce the overall operating efficacy of the transformer. Also, loose flakes within the oil of an oil filter transformer is also known to reduce the dielectric strength of the immersing oil and thereby also reduce the overall operating efficiency of such oil-filter transformers. These and other shortcomings are addressed, and successfully overcome by the transformer core, and methods of manufacture described herein.

While the invention is susceptible of various modifications and alternative forms, it is to be understood that specific embodiments thereof have been shown by way of example in the drawings which are not intended to limit the invention to the particular forms disclosed; on the contrary the intention is to cover all modifications, equivalents and alternatives falling within the scope and spirit of the invention as expressed in the appended claims.

What is claimed is:

1. A process for the manufacture of a wound, multi-cored amorphous metal transformer core, which process comprises the steps of:

producing a series of cut strips from an unannealed amorphous metal which is at least 90% glassy and has a nominal composition according to the formula $$M_{70\text{-}85}Y_{5\text{-}20}Z_{0\text{-}20}$$

wherein the subscripts are in atom percent, "M" is at least one of Fe, Ni and Co. "Y" is at least one of B, C and P, and "Z" is at least one of Si, Al and Ge; with the proviso that (i) unto 10 atom percent of component "M" can be replaced with at least one of the metallic species Ti, V, Cr, Mn, Cu, Zr, Nb, Mo, Ta, and W, and (ii) up to 10 atom percent of components (Y+Z) can assembling the unannealed cut strips into groups, each group comprising a plurality of cut strips layered in register;

assembling the groups into a plurality of packets;

forming the packets about a mandrel to form unannealed transformer cores having core windows, each core having a single laceable joint;

assembling the unannealed transformer cores into a configuration suited for use within an assembled transformer;

annealing the assembled unannealed transformer cores; thereafter unlacing each of the transformer cores and subsequently replacing the transformer cores.

2. The process according to claim 1 wherein the multicored amorphous metal transformer core is a 3-limbed amorphous metal transformer core comprising an outer core section encasing two inner core sections within its interior.

3. A process for the manufacture of a power transformer which includes a wound, multicored amorphous metal transformer core, which process comprises the steps of:

producing a series of cut strips from an unannealed amorphous metal which is at least 90% glassy and has a nominal composition according to the formula $$M_{70\text{-}85}Y_{5\text{-}20}Z_{0\text{-}20}$$

wherein the subscripts are in atom percent, "M" is at least one of Fe, Ni and Co. "Y" is at least one of B, C and P, and "Z is at least one of Si, Al and Ge; with the proviso that (i) up to 10 atom percent of component "M" can be replaced with at least one of the metallic species Ti, V, Cr, Mn, Cu, Zr, Nb, Mo, Ta and W, and (ii) up to 10 atom percent of components (Y+Z) can be replaced by at least one of the non-metallic species In, Sn, Sb, and Pb;

assembling the unannealed cut strips into groups, each group comprising a plurality of cut strips layered in register;

assembling the groups into a plurality of packers;

forming the packets about a mandrel to form unannealed transformer cores having core windows, each core having a single laceable joint;

assembling the unannealed transformer cores into a configuration suited for use within an assembled transformer;

annealing the assembled unannealed transformer cores; unlacing each of the transformer cores to permit insertion of one or more transformer coils;

inserting the coils onto one or more of the transformer cores; and subsequently replacing the transformer cores to reconstitute the transformer cores.

4. A process according to claim 4 wherein the power transformer is a 3-limbed, 3-phase power transformer.

* * * * *